US006305465B1

(12) United States Patent
Uchikawa et al.

(10) Patent No.: US 6,305,465 B1
(45) Date of Patent: Oct. 23, 2001

(54) DOUBLE HEAT EXCHANGER HAVING CONDENSER CORE AND RADIATOR CORE

(75) Inventors: Akira Uchikawa; Takaaki Sakane, both of Nagoya; Satomi Muto, Nishikasugai-gun; Tatsuo Sugimoto, Okazaki, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 09/247,801

(22) Filed: Feb. 8, 1999

(30) Foreign Application Priority Data

Feb. 24, 1998 (JP) ..... 10-042303
Jul. 10, 1998 (JP) ..... 10-196018

(51) Int. Cl.[7] ..... F28F 9/26
(52) U.S. Cl. ..... 165/140; 165/135; 165/175
(58) Field of Search ..... 165/67, 175, 140, 165/173, 149, 144, 135; 180/68.4

(56) References Cited

U.S. PATENT DOCUMENTS 2,014,028 * 9/1935 Palmer ..... 165/140 X
3,368,617 * 2/1968 Rosman et al. ..... 165/175
3,866,675 * 2/1975 Bardon et al. ..... 165/173
4,349,440 * 9/1982 Esmond ..... 165/175 X
4,997,033 * 3/1991 Ghiani et al. ..... 165/67
5,000,257 * 3/1991 Shinmura ..... 165/140
5,139,080 * 8/1992 Bolton et al. ..... 165/67
5,163,505 * 11/1992 Hoffman et al. ..... 165/67
5,219,016 * 6/1993 Bolton et al. ..... 165/67 X
5,348,081 * 9/1994 Halstead et al. ..... 165/144
5,657,817 * 8/1997 Heine et al. ..... 165/67
6,000,460 * 12/1999 Yamanaka et al. ..... 165/67
6,095,239 * 8/2000 Makino et al. ..... 165/140

FOREIGN PATENT DOCUMENTS 9-152298 * 6/1997 (JP) ..... 165/135
9-222293 8/1997 (JP) .
10-122785 5/1998 (JP) .

* cited by examiner

*Primary Examiner*—Leonard Leo
(74) *Attorney, Agent, or Firm*—Harness, Dickey & Pierce, PLC

(57) ABSTRACT

A double heat exchanger includes a condenser having a condenser core and a condenser header tank, and a radiator having a radiator core and a radiator header tank. The condenser header tank is composed of a core plate having clamping portions and a tank portion having protruding portions. The protruding portions of the tank portion are clamped by the clamping portions of the core plate so that the tank portion is connected to the core plate in the condenser header tank. The protruding portions of the condenser header tank contacts the radiator header tank, thereby preventing the condenser and radiator header tanks from being inclined toward each other. Therefore, the condenser and radiator header tanks contact and are brazed to each other in a relatively small area. As a result, heat conduction from the radiator to the condenser is prevented, and heat exchange performance of the condenser can be improved.

2 Claims, 10 Drawing Sheets

DOUBLE HEAT EXCHANGER HAVING CONDENSER CORE AND RADIATOR CORE

CROSS-REFERENCE TO RELATED APPLICATION

This application relates to and claims priority from Japanese Patent Applications No. Hei. 10-42303 filed on Feb. 24, 1998 and No. Hei. 10-196018 filed on Jul. 10, 1998, the contents of which are hereby incorporated by reference.

BACKGROUND OF THE INVENTION

1. Field of the Invention

The present invention relates to a double heat exchanger having several core portions such as a condenser core for a refrigerant cycle and a radiator core for cooling engine cooling water of a vehicle.

2. Related Art

In a conventional double heat exchanger having a condenser core and a radiator core, a condenser header tank and a radiator header tank are disposed to be close to each other to reduce the size of the double heat exchanger. When the condenser and the radiator header tanks are respectively assembled to the condenser and radiator cores, the condenser and radiator header tanks tends to be inclined. Therefore, in this case, the condenser and radiator header tanks may contact to each other in a relatively large area, and may be bonded to each other through brazing. As a result, heat transfers from the radiator header tank to the condenser header tank, thereby decreasing heat exchange performance of the condenser core of the double heat exchanger.

SUMMARY OF THE INVENTION

In view of the foregoing problems, it is an object of the present invention to provide a double heat exchanger having a first and second cores, which prevents a first header tank connected to the first core and a second header tank connected to the second core from being inclined while improving heat exchange performance.

According to the present invention, in a double heat exchanger having a first core and a second core, a first header tank connected to the first core has a protruding portion protruding toward a second header tank connected to the second core, and the protruding portion of the first header contacts the second header tank. Therefore, the first and second header tanks are prevented from being inclined toward each other, thereby preventing the first and second header tanks from contacting and being brazed to each other in a large area. Thus, heat conduction between the first and second header tanks is restricted, and heat exchanger performance of the double heat exchanger is improved.

Preferably, at least three protrusions are separately formed on the first header tank along a longitudinal direction of the first header tank. Therefore, the double heat exchanger prevents the first and second header tanks from being inclined without greatly reducing the heat exchange performance.

Further, a total of each length of each contact surface between the protrusions of the first header tank and the second header tank in a longitudinal direction of the second header tank is set to be equal to 50% or less of an entire longitudinal length of the second header tank. Even in this case, the double heat exchanger can prevent the heat exchange performance from being greatly reduced.

More preferably, the first header tank is composed of a first plate and a first tank portion. The first plate has a clamping portion and the protruding portion is formed on the first tank portion. When the first tank portion is connected to the first plate of the first header tank, the clamping portion of the first plate is bent in the longitudinal direction of the first header tank to clamp the protruding portion. Thus, the first plate and the first tank portion of the first header tank can be readily assembled.

Still more preferably, the second header tank is composed of a second plate and a second tank portion connected to the second plate, each of the second plate and the second tank portion is formed into a L-shaped cross-section to have a bending portion extending in a longitudinal direction of the second header tank, and the bending portion of the second plate is arranged at a side adjacent to the first header tank to face the first header tank. Therefore, the second plate and the second tank portion of the second header tank can be readily assembled, and connection portions of the second header tank can be readily checked.

BRIEF DESCRIPTION OF THE DRAWINGS

Additional objects and advantages of the present invention will be more readily apparent from the following detailed description of preferred embodiments when taken together with the accompanying drawings, in which.

DETAILED DESCRIPTION OF THE PREFERRED EMBODIMENTS

Preferred embodiments of the present invention are described hereinafter with reference to the accompanying drawings.

Figure 1:
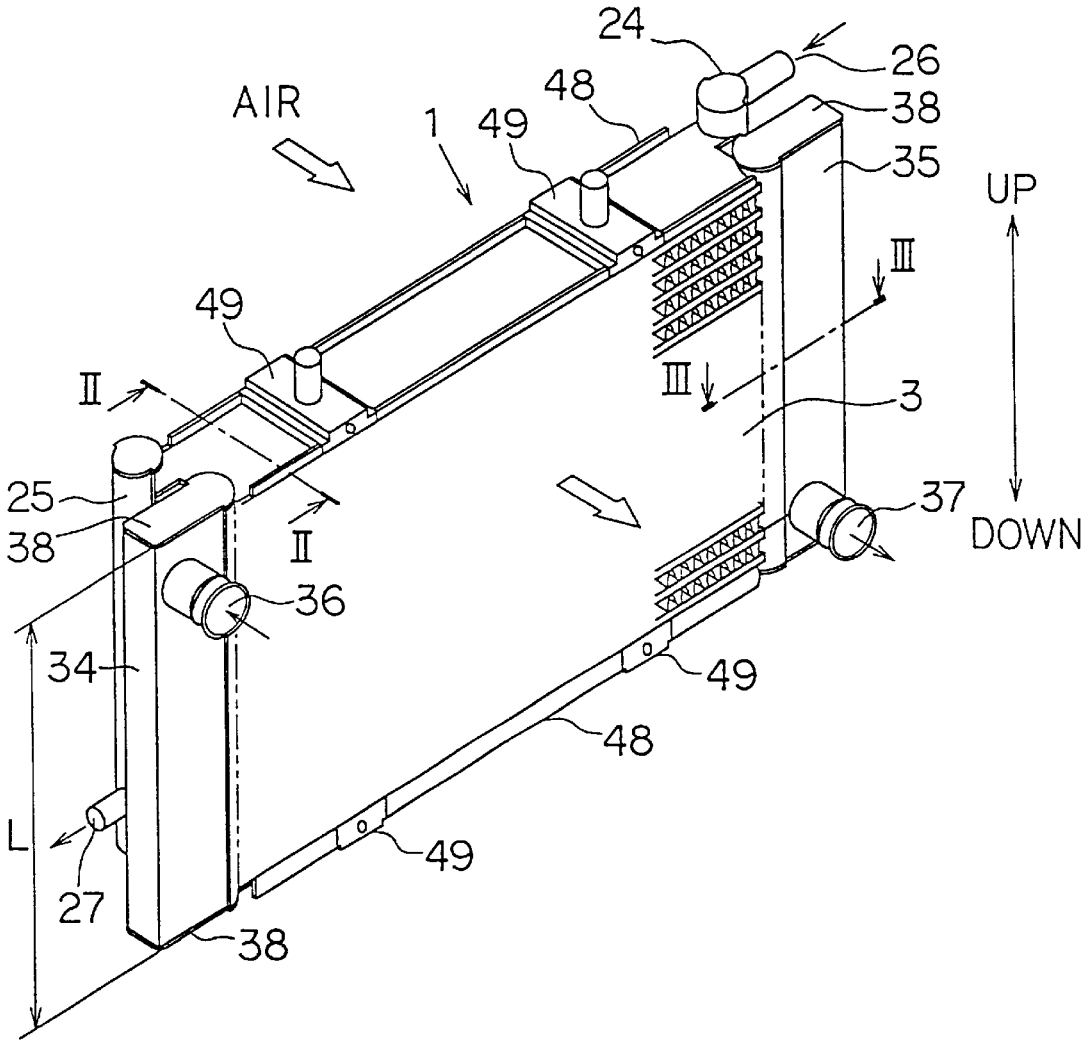
FIG. 1 is a schematic perspective view showing a double heat exchanger according to a first preferred embodiment of the present invention.

A first preferred embodiment of the present invention will be described with reference to FIGS. 1–8B. As shown in FIG. 1, a double heat exchanger 1 (hereinafter refereed to as heat exchanger 1) for a vehicle has a condenser core 2 (i.e., first core) of a refrigerant cycle and a radiator core 3 (i.e., second core) for cooling engine cooling water discharged from a vehicle engine (not shown).

Generally, temperature of refrigerant flowing through the condenser core 2 is lower than temperature of engine cooling water flowing through the radiator core 3. Therefore, the condenser core 2 is disposed on an upstream air side of the radiator core 3. Thus, the condenser and radiator cores 2, 3 are arranged in a straight line in an air flowing direction at a most front portion of an engine compartment of the vehicle.

Figure 2:
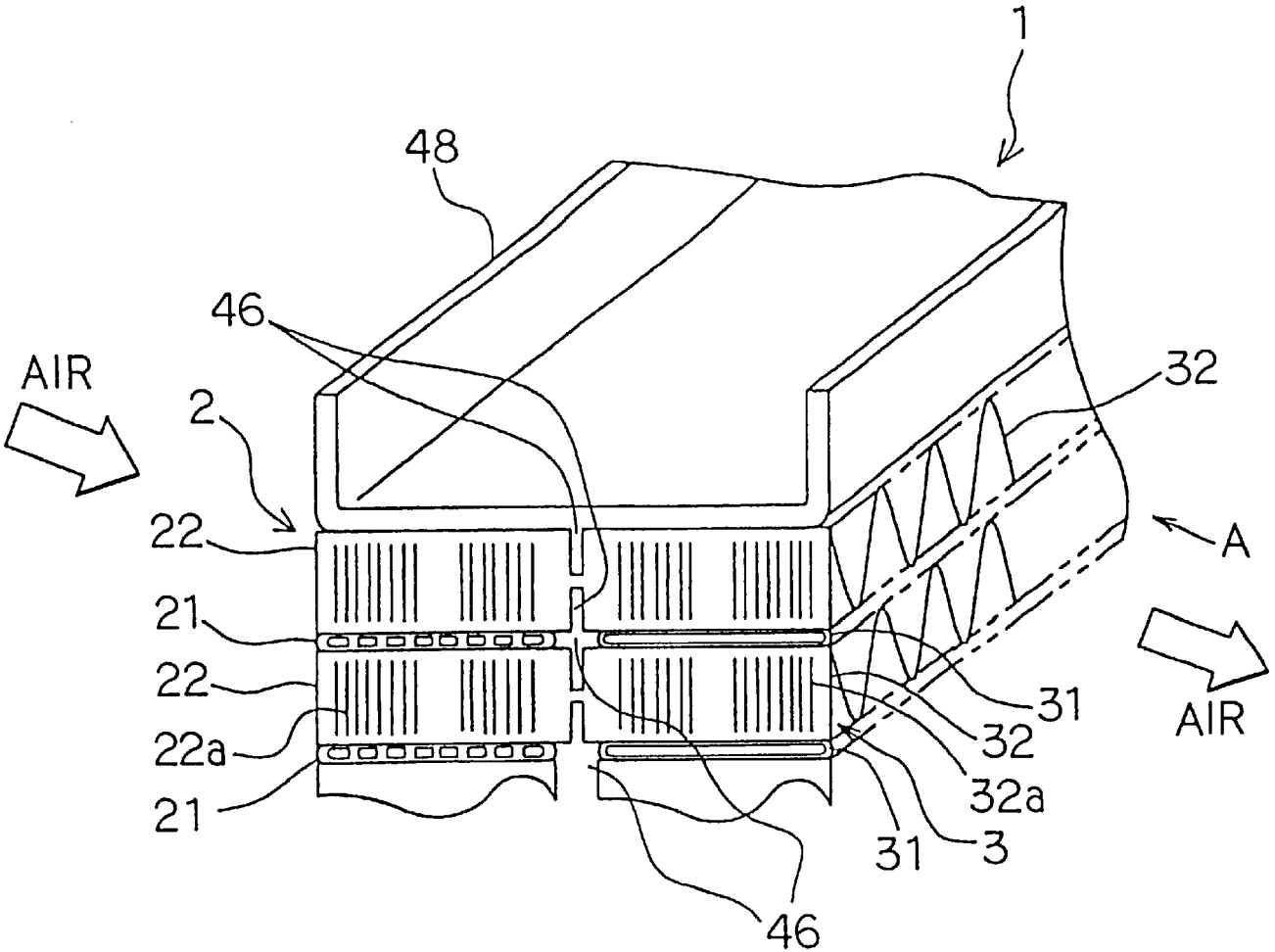
FIG. 2 is a perspective view taken along line II—II in FIG. 1, showing a part of a condenser core and a radiator core according to the first embodiment.

As shown in FIG. 2, the condenser core 2 and the radiator core 3 are disposed to have a predetermined gap 46 therebetween so that heat conduction therebetween is prevented. The condenser core 2 has plural flat condenser tubes 21 in which refrigerant of the refrigerant cycle flows, and plural corrugated cooling fins 22 connected to the condenser tubes 21 by brazing. The radiator core 3 has a structure similar to that of the condenser core 2, and has plural flat radiator tubes 31 and plural corrugated cooling fins 32. The condenser and radiator tubes 21, 31 are laminated in parallel, and the cooling fins 22, 32 are attached between each adjacent flat tubes 21, 31 through brazing, respectively. Further, the cooling fins 22, 32 respectively have louvers 22*a*, 32*a* for facilitating heat exchange. The louvers 22*a*, 32*a* are integrally formed with the cooling fins 22, 32, respectively, by a method such as roller forming.

Referring back to FIG. 1, radiator header tanks 34, 35 extending in an extending direction perpendicular to a longitudinal direction of the radiator tubes 31 are connected to each longitudinal end of the radiator tubes 31 by brazing. Engine cooling water flowing into the radiator header tank 34 is distributed to each of the radiator tubes 31. After heat exchange between engine cooling water within the radiator tubes 31 and air passing through the radiator core 3 is performed, engine cooling water in the radiator tubes 31 flows into the radiator header tank 35 to be gathered therein. The radiator header tank 34 has an inlet 36 through which engine cooling water from the engine is introduced, at an upper end. On the other hand, the radiator header tank 35 has an outlet 37 through which engine cooling water is discharged toward the engine, at a lower end.

Similarly, condenser header tanks 24, 25 extending in an extending direction perpendicular to a longitudinal direction of the condenser tubes 21 are connected to each longitudinal end of the condenser tubes 21 by brazing, respectively. Therefore, the condenser header tanks 24, 25 and the radiator header tanks 34, 35 are disposed to parallel to each other. Refrigerant flowing into the condenser header tank 24 is distributed to each of the condenser tubes 21. After heat exchange between refrigerant within the condenser tubes 31 and air is performed in the condenser core 2, refrigerant flows into the condenser header tank 25 to be gathered therein. An inlet 26 for introducing refrigerant discharged from a compressor (not shown) of the refrigerant cycle is provided in the condenser header tank 24 at an upper end. An outlet 27 through which condensed refrigerant is discharged toward an expansion valve (not shown) of the refrigerant cycle is formed in the condenser header tank 25 at a lower end. Side plates 48 are attached to the heat exchanger 1 to enhance strength of the condenser and radiator cores 2, 3. The heat exchanger 1 is mounted on the vehicle using brackets 49.

The condenser header tanks 24, 25 have the same structure from each other, and the radiator header tanks 34, 35 have the same structure from each other. Therefore, only the condenser header tank 24 and the radiator header tank 35 will be described as an example.

Figure 3:
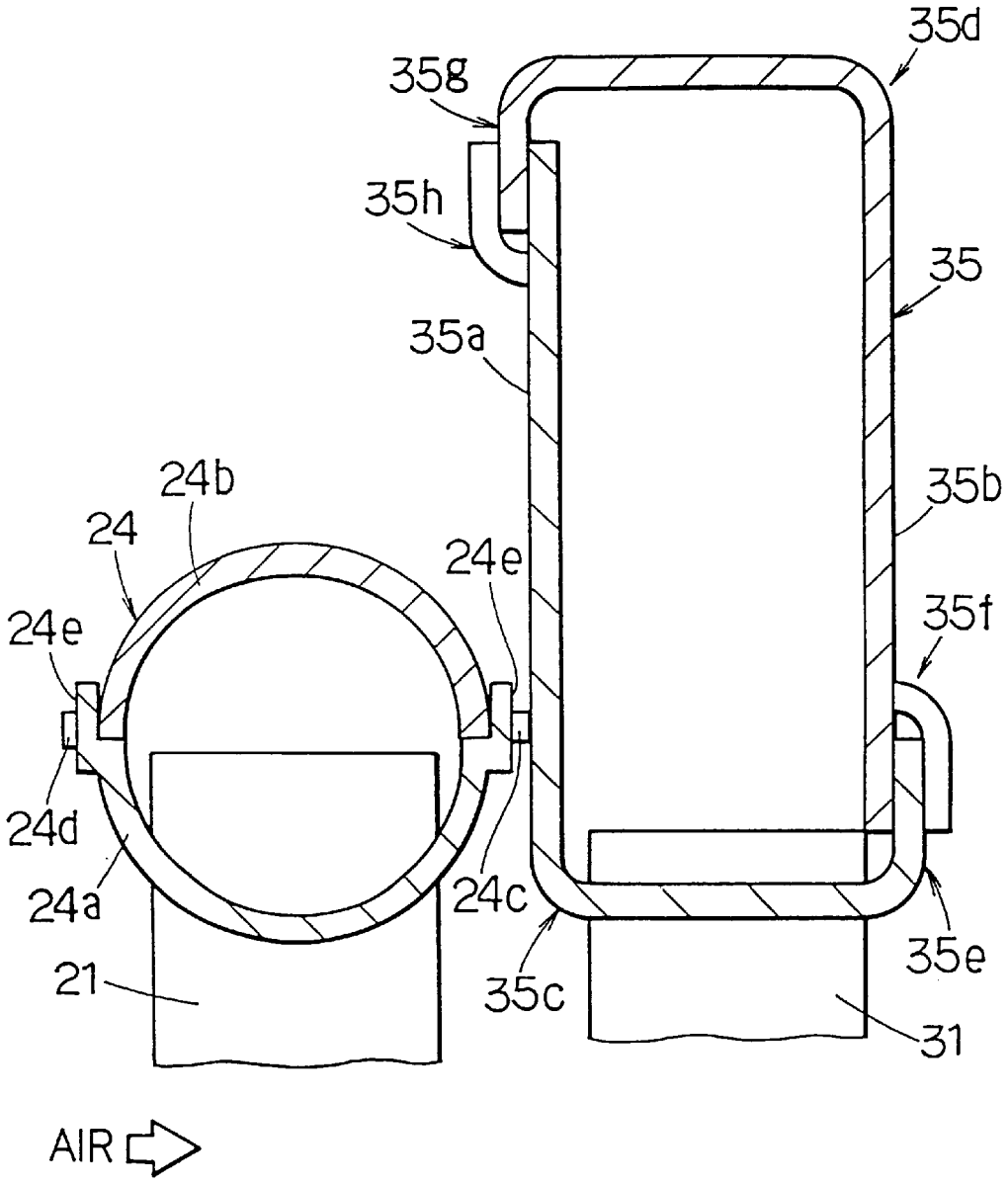
FIG. 3 is a cross-sectional view taken along line III—III in FIG. 1, showing a condenser header tank and a radiator header tank according to the first embodiment.
Figure 4:
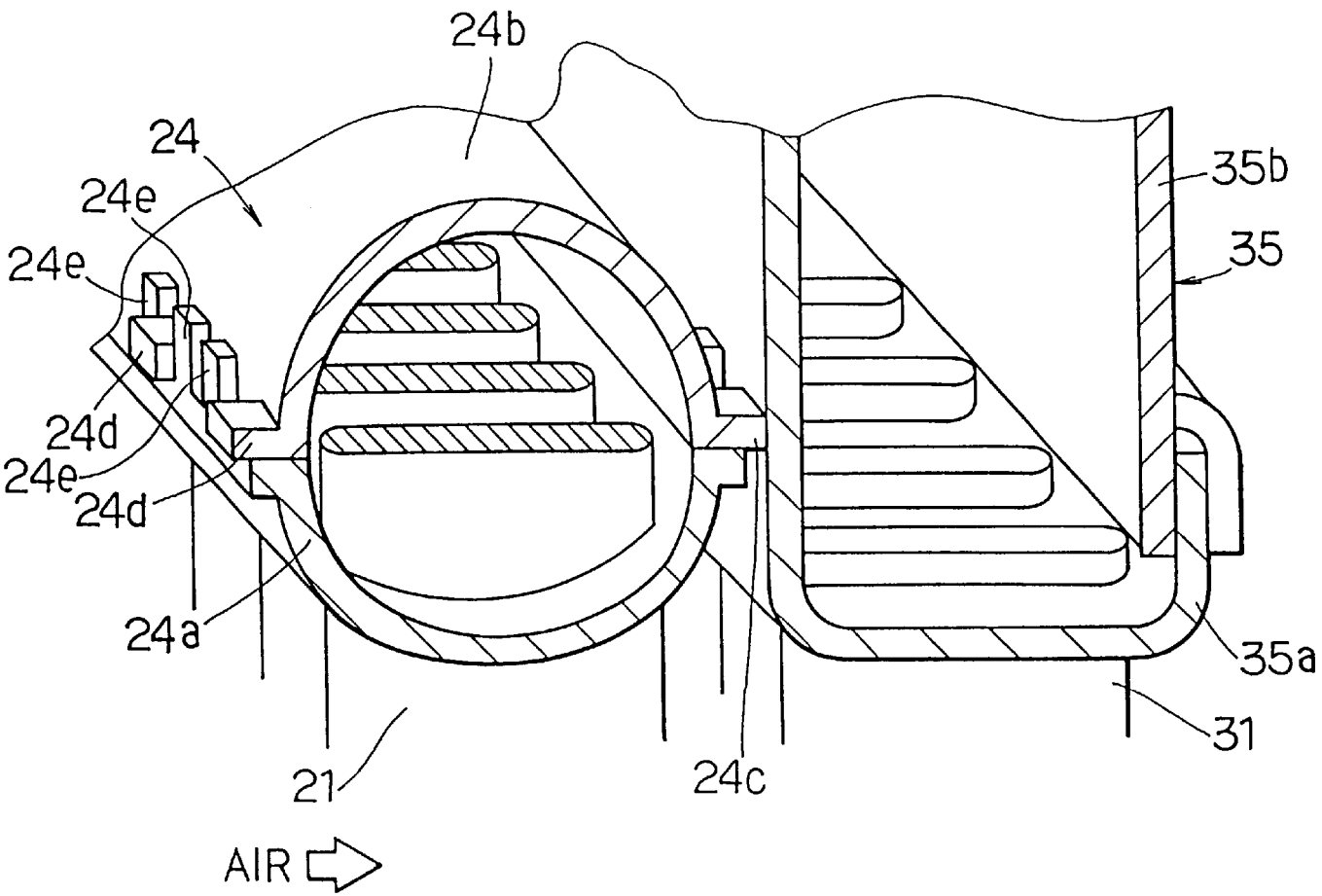
FIG. 4 is a perspective view taken along line III—III in FIG. 1, showing the condenser header tank and the radiator header tank according to the first embodiment.
Figure 5:
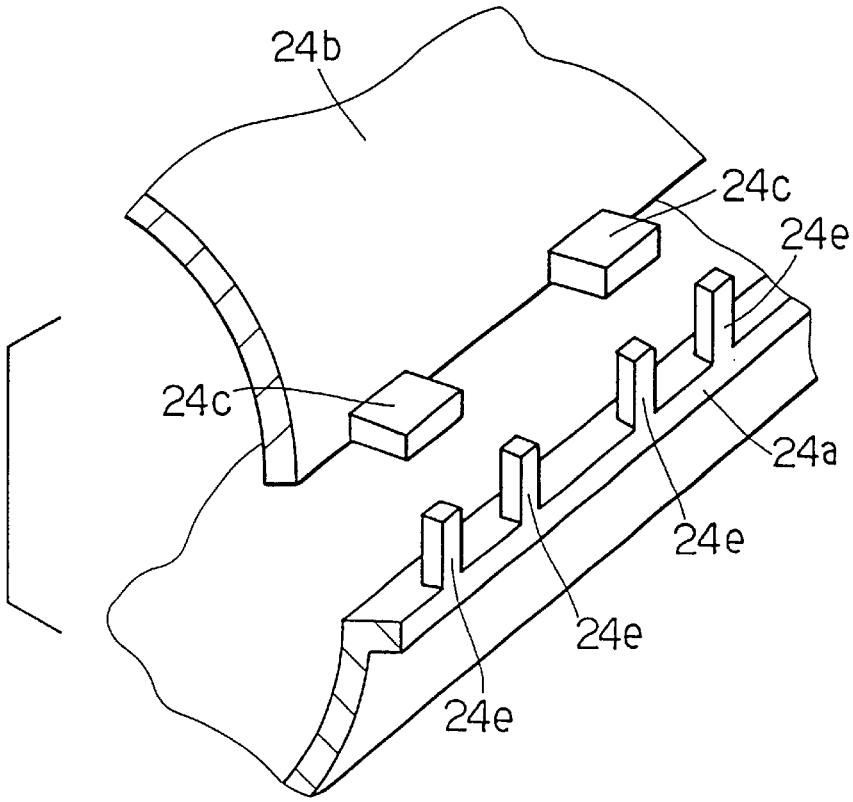
FIG. 5 is a disassembled perspective view of the condenser header tank according to the first embodiment.
Figure 6:
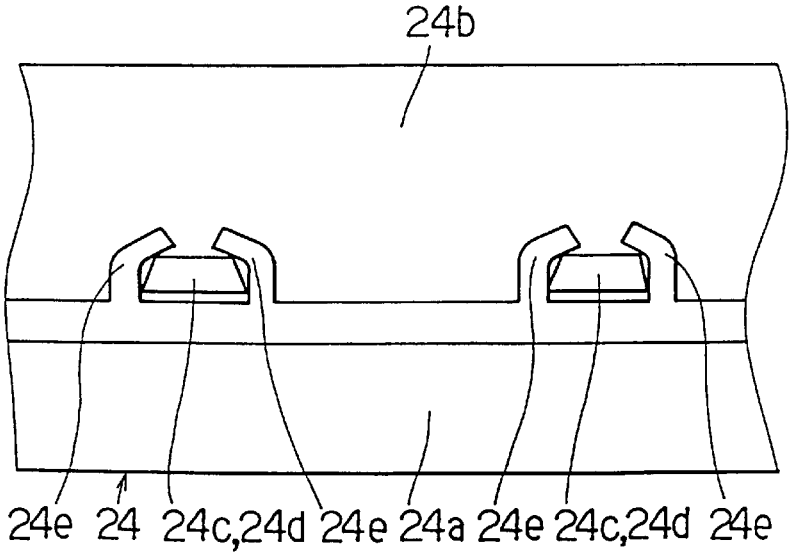
FIG. 6 is a side view showing the assembled condenser header tank according to the first embodiment.

As shown in FIGS. 3, 4, the condenser header tank 24 is composed of a condenser core plate 24*a* and a tank portion 24*b*. The core plate 24*a* is connected to the condenser tubes 21, and the tank portion 24*b* is connected to the core plate 24*a*. Several first protruding portions 24*c* are separately formed in the tank portion 24*b* at a side of the radiator header tank 35 to protrude toward the radiator header tank 35 and to contact the radiator header tank 35. In the first embodiment, at least three first protruding portions 24*c* are separately formed on the tank portion 24*b* along an extending direction of the condenser header tank 24.

Several second protruding portions 24*d* are formed in the tank portion 24*b* of the condenser header tank 24 at a side opposite to the radiator header tank 35 to protrude in an opposite direction with respect to the first protruding portions 24*c*. In the first embodiment, at least three second protruding portions 24*d* are separately formed on the tank portion 24*b* along the extending direction of the condenser header tank 24, so that the first protruding portions 24*c* are symmetrical with the second protruding portions 24*d*.

The core plate 24*a* of the condenser header tank 24 has several clamping portions 24*e* protruding toward the tank portion 24*b*, at positions corresponding to the protruding portions 24*c*, 24*d*. The clamping portions 24*e* are bent by plastic deformation in the extending direction of the condenser header tank 24 to clamp the protruding portions 24*c*, 24*d*, so that the tank portion 24*b* of the condenser header tank 24 is fastened to the core plate 24*a* of the condenser header tank 24.

On the other hand, as shown in FIGS. 3, 4, the radiator header tank 35 has a radiator core plate 35*a* connected to the radiator tubes 31, and a radiator tank portion 35*b* connected to the core plate 35*a*. The core plate 35*a* and the tank portion 35*b* are bent by pressing, to respectively have bending portions 35*c*, 35*d* extending in an extending direction of the radiator header tank 35. Thus, each of the core plate 35*a* and the tank portion 35*b* of the radiator header tank 35 has a L-shaped cross-section. The bending portion 35*c* of the core plate 35*a* is positioned at a side adjacent to the condenser header tank 24 to face the condenser header tank 24.

Figure 7A:
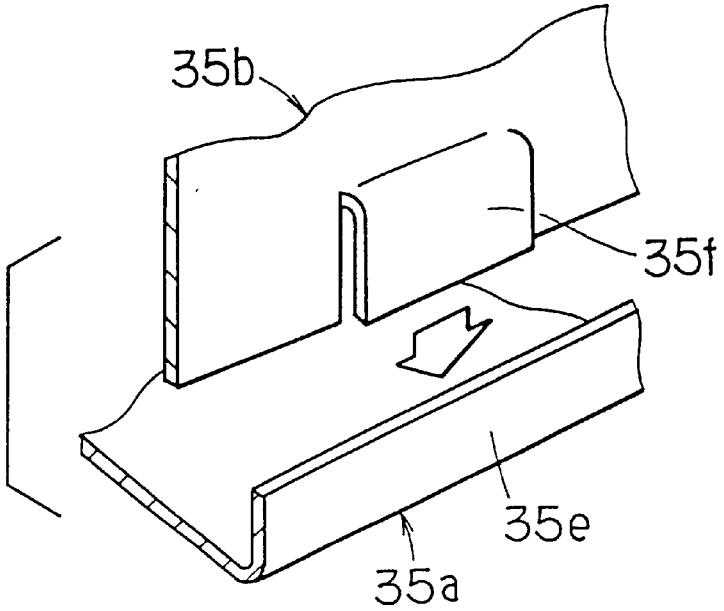
FIG. 7A is a disassembled perspective view of the radiator header tank according to the first embodiment.
Figure 7B:
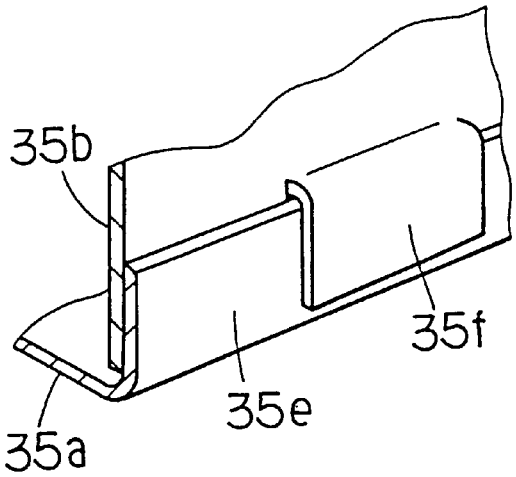
FIG. 7B is a perspective view showing the assembled radiator header tank according to the first embodiment.

The core plate 35*a* has a fastening portion 35*e* formed integrally with the bending portion 35*c*, at a side opposite to the bending portion 35*c*. On the other hand, the tank portion 35*b* has a clamping portion 35*f* at a position corresponding to the fastening portion 35*e*. The clamping portion 35*f* is formed by cutting and rasing a part of the tank portion 35*b*. As shown in FIGS. 7A, 7B, the fastening portion 35*e* of the core plate 35*a* is inserted into the clamping portion 35*f* of the tank portion 35*b*, so that the core plate 35*a* is connected to the tank portion 35*b* of the radiator header tank 35. the other hand, as shown in FIG. 3, the tank portion 35*b* has a fastening portion 35*g* and the core plate 35*a* has a clamping portion 35*h*, at a side adjacent to the condenser header tank 24. The fastening portion 35*g* of the tank portion 35*b* is inserted into the clamping portion 35*h* of the core plate 35*a*, so that the tank portion 35*b* is connected to the core plate 35*a* of the radiator header tank 35.

Next, a manufacturing method of the heat exchanger 1 according to the first embodiment will be described.

The condenser tubes 21 and the radiator tubes 31 are respectively formed by extrusion or drawing using aluminum in a tube forming step. Welded tubes such as electric-resistance welded tubes may be used as the radiator tubes 31, for example.

Each of the core plates 24*a*, 35*a*, the tank portions 24*b*, 35*b*, and the side plates 48 is formed by pressing an aluminum plate in a pressing step. Each one side surface of the core plates 24*a*, 35*a* and the tank portion 35*b* being arranged at an outside of the header tanks 24, 35, and both inner and outer sides of the tank portion 24*b* are coated with a brazing material.

Figure 8A:
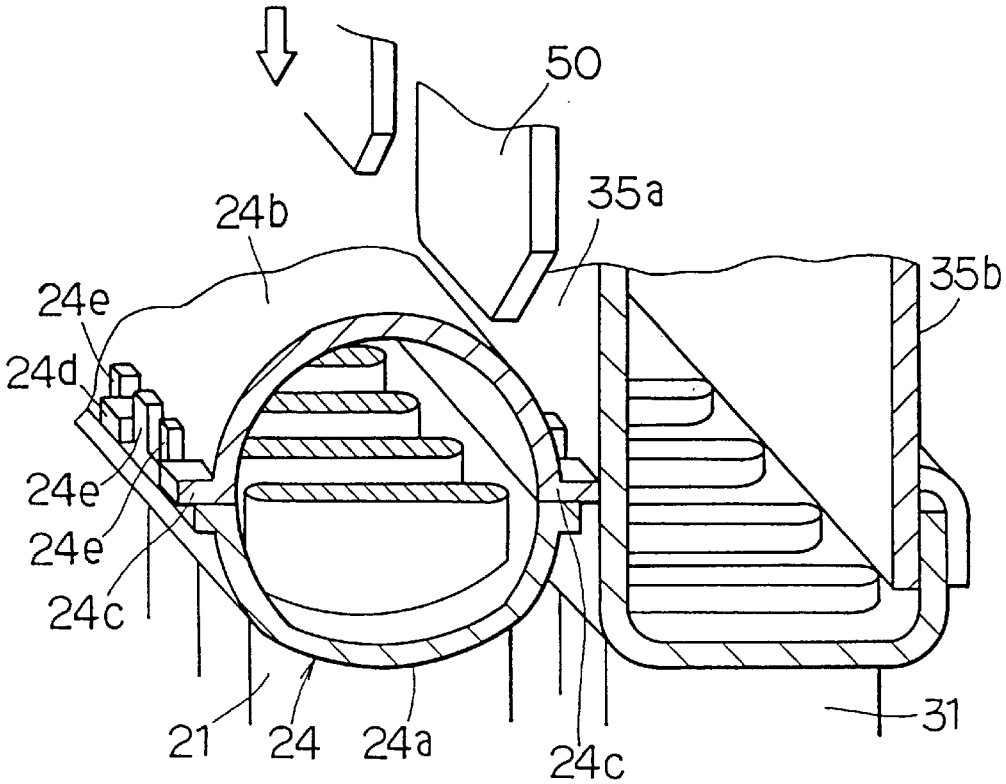
FIG. 8A is a perspective view taken along line III—III in FIG. 1.
Figure 8B:
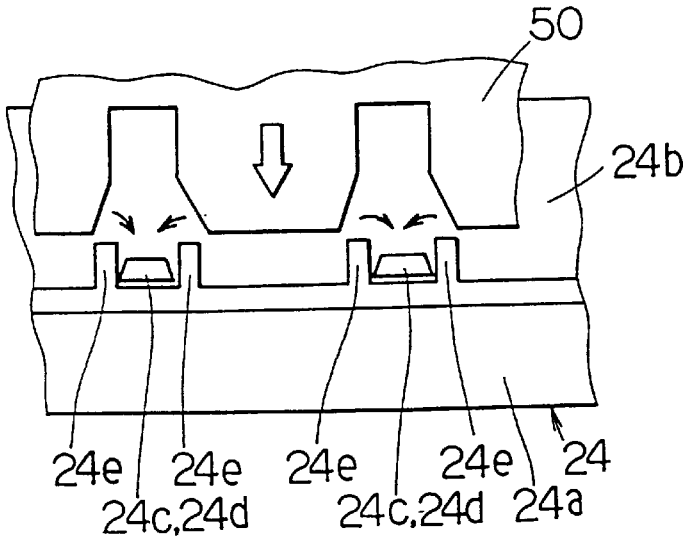
FIG. 8B is a side view, for explaining an assembling step of the condenser header tank using a clamping jig according to the first embodiment.

Next, the condenser and radiator tubes 21, 31 and the cooling fins 22, 32 are provisionally assembled to form the condenser and radiator cores 2, 3, respectively, and the side plate 48 is provisionally attached to both ends of the cores 2, 3 using a fastening jig such as wire, during a first assembling step. Further, the condenser and radiator tubes 21, 31 are inserted into the core plates 24*a*, 35*a*, and the tank portions 24*b*, 35*b* are provisionally connected with the core plates 24*a*, 35*a* , respectively, during a second assembling step. In the second assembling step, as shown in FIGS. 8A, 8B, a clamping jig 50 is forced to the clamping portions 24*e* of the core plate 24*a* from a side of the tank portion 24*b* of the condenser header tank 24. When the clamping jig 50 is pressed against the clamping portions 24*e*, the clamping portions 24*e* are deformed to be bent in the longitudinal direction of the condenser header tank 24 to clamp the protruding portions 24*c*, 24*d*. Thus, the clamping portions 24*e* is tightly engaged with the protruding portions 24*c* , 24*d* , and so that the tank portion 24*b* is fastened to the core plate 24*a*.

The provisionally assembled body in the second assembling step is heated in a furnace and is integrally brazed in a brazing step. Brazing performance and dimensions of the formed heat exchanger 1 are checked and any errors is removed in an inspection step.

In the first embodiment, the first protruding portions 24*c* of the condenser header tank 24 may be not necessarily brazed to the radiator header tank 35, provided that the first protruding portions 24*c* of the condenser header tank 24 contacts the radiator header tank 35.

According to the first embodiment, the first protruding portions 24*c* of the condenser header tank 24 contacts the core plate 35*a* of the radiator header tank 35. Therefore, the condenser and radiator header tanks 24, 35, especially, the radiator header tank 35 which tends to be inclined due to its relatively large size, can be prevented from being inclined. As a result, the condenser and radiator header tanks 24, 35 can be brazed to each other during the brazing step while contacting with each other with a relatively small area. Therefore, heat does not greatly transfer from the radiator header tank 35 to the condenser header tank 24, thereby preventing heat exchange performance of the condenser core 2 from being greatly decreased.

However, because the first protruding portions 24*c* of the condenser header tank 24 contacts the radiator header tank 35, heat slightly transfers from the radiator header tank 35 to the condenser header tank 24 through the contact portion. Therefore, in the first embodiment, a total of each length of each contact surface between the radiator header tank 35 and the first protruding portions 24*c* of the condenser header tank 24 in the extending direction of the radiator header tank 35 (hereinafter, the total length is referred to as contact length) is set to approximately 20% or less of the entire length L of the radiator header tank 35 in the longitudinal direction (extending direction). Therefore, heat conduction from the radiator header tank 35 to the condenser header tank 24 can be restricted to be relatively small. For example, when a single first protruding portion 24*c* is provided in the condenser header tank 24, the contact length of the single first protruding portion 24*c* of the condenser header tank 24 is set to approximately 20% or less of the length L of the radiator header tank 35.

As shown in FIG. 1, the length L of the radiator header tank 35 does not include a length of cap portions 38 attached to both longitudinal ends of the radiator header tank 35. In FIG. 1, the length L of the radiator header tank 35 is the same as that of the radiator header tank 34, in the first embodiment.

Further, according to the first embodiment, the clamping portions 24*e* are readily bent with plastic deformation in the extending direction of the condenser header tank 24 toward the protruding portions 24*c*, 24*d* using the clamping jig 50. Therefore, in the condenser header tank 24, the tank portion 24*b* is readily fixed to the core plate 24*a*. Further, because the clamping jig 50 is inserted between the condenser and radiator header tanks 24, 35 from the side of the tank portion 24*b*, the clamping portions 24*e* are readily bent. Thus, assembly effect and assembly reliability of the condenser header tank 24 is improved, and the manufacturing step of the heat exchanger 1 can be reduced. Further, because brazing errors between the core plate 24*a* and the tank portion 24*b* of the condenser header tank 24 can be prevented, the heat exchanger 1 can be produced in low cost.

Further, in the first embodiment, the bending portion 35*c* of the core plate 35*a* is arranged at a side adjacent to the condenser header tank 24 to face the condenser header tank 24. Therefore, as shown in FIG. 3, connection portions between the core plate 35*a* and the tank portion 35*b*, such as the fastening portions 35*e*, 35*g* and the clamping portions 35*f*, 35*h*, are sufficiently viewed without being obstructed by the condenser header tank 24. Thus, brazing connection portions of the condenser and radiator header tanks 24, 35, such as the fastening portions 35*e*, 35*g* and the clamping portions 35*e*, 35*h* of the radiator header tank 35, and connection portions between the core plate 24*a* and the tank portion 24*b* of the condenser header tank 24 are readily approached. Thus, any brazing errors of the header tanks 24, 35 can be readily found during the inspection step and are readily corrected. As a result, the yield of the heat exchanger 1 is improved, thereby reducing the manufacturing cost thereof.

In the above-described first embodiment, the gap 46 between the condenser core 2 and the radiator core 3 is closed by the side plate 48 at the end portions of the condenser and radiator cores 2, 3, as shown in FIG. 2. Therefore, air passing through the radiator core 3 passes through the condenser core 2 without bypassing the condenser core 2. As a result, an amount of air passing through the condenser core 2 of the heat exchanger 1 is increased as compared with a double heat exchanger in which a gap between a condenser core and a radiator core is not closed by a side plate.

Figure 9:
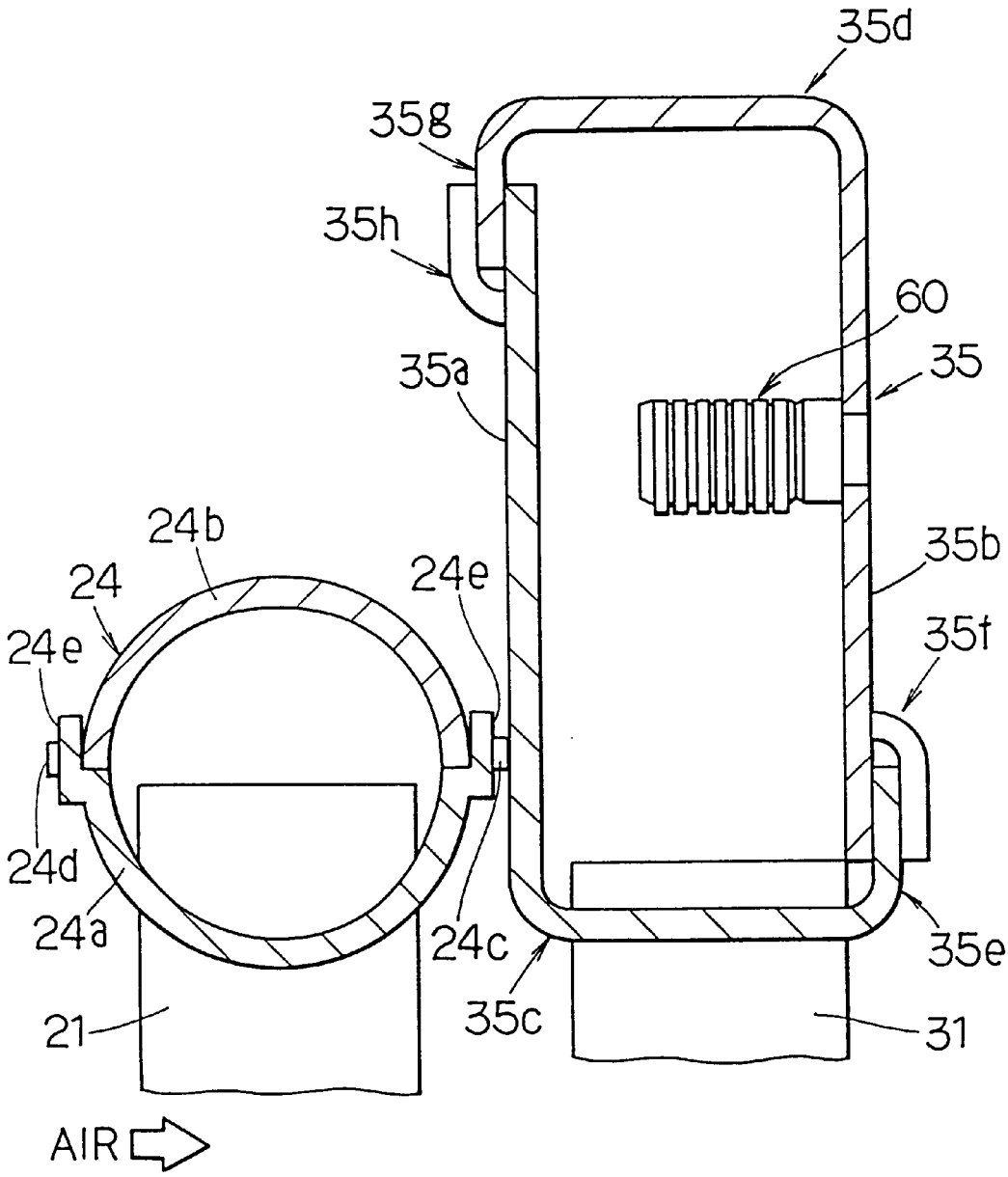
FIG. 9 is a cross-sectional view showing a condenser header tank and a radiator header tank according to a second preferred embodiment of the present invention.

A second preferred embodiment of the present invention will be described with reference to FIG. 9. In this and following embodiments, components which are similar to those in the first embodiment are indicated with the same reference numerals, and the explanation thereof is omitted.

In the second embodiment, an oil cooler 60 which cools engine oil or mission oil (e.g., automatic transmission oil) is disposed in the radiator header tank 35. The oil cooler 60 is attached to the tank portion 35*b* firstly in a sub assembling step, and then the sub-assembly of the tank portion 35*b* and the oil cooler 60 is attached to the core plate 35 of the radiator header tank 35. Thus, the oil cooler 60 is readily installed in the radiator header tank 35. Other additional devices may also be disposed in the radiator header tank 35 in the same method as that of the oil cooler 60.

Figure 10A:
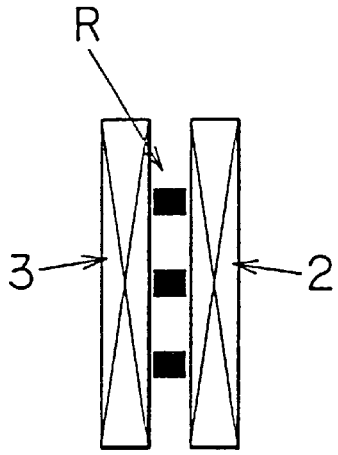
FIG. 10A is a schematic diagram for explaining a tank connection ratio (R) between a condenser header tank and a radiator header tank according to a third preferred embodiment of the present invention.
Figure 10B:
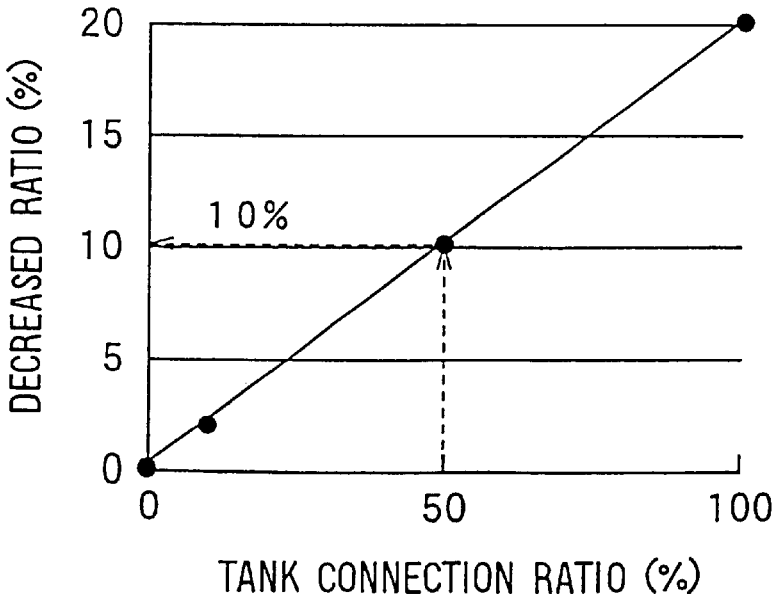
FIG. 10B is a graph showing the relationship between the tank connection ratio and a decreased ratio of heat exchange performance of a condenser core.

A third preferred embodiment of the present invention will be described with reference to FIGS. 10A, 10B. In the first and second embodiments, a ratio R of the total contact length of the contact surfaces between the radiator header tank 35 and the first protruding portions 24*c* to the length L of the radiator header tank 35 (hereinafter, the ratio is referred to as tank connection ratio) is set to 20% or less. In the third embodiment, the tank connection ratio R of the heat exchanger 1 is set to be equal to or less than 50%. As shown in FIG. 10B, in this case, a decreased ratio of heat exchange performance of the condenser core 2 is less than approximately 10% as compared with a double heat exchanger having the tank connection ratio R of 0%, in which the first protruding portion 24*c* does not contact the radiator header tank 35. Further, in the present invention, the gap 46 between the condenser core 2 and the radiator core 3 is closed by the side plate 48 at the end portions of the condenser and radiator cores 2, 3. Therefore, air passing through the radiator core 3 passes through the condenser core 2 without bypassing the condenser core 2. Thus, even when the tank connection ratio R is set to be equal to or less than 50% in the third embodiment, it can prevent the heat exchange performance of the condenser core 2 from being greatly reduced.

FIG. 10B shows the relationship between the tank connection ratio R and the decreased ratio of the heat exchange performance of the condenser core 2. The heat exchange performance of the condenser core 2 in FIG. 10B is detected under a condition corresponding to vehicle idling, in which the condenser core 2 needs to be fully operated. FIG. 10A is indicated to readily explaining the tank connection ratio R. The tank connection ratio R is obtained by the following formula (1)

$$R = \text{tank contact area}/(\text{tank length } L \times \text{tank contact width}) \quad (1)$$

in which, the tank contact area between the condenser core 2 and the radiator core 3 is calculated by multiplying the total contact length and the tank contact width of the contact surface together, and the tank contact width is a length of the contact surface in a direction perpendicular to the contact length.

Although the present invention has been fully described in connection with preferred embodiments thereof with reference to the accompanying drawings, it is to be noted that various changes and modifications will become apparent to those skilled in the art.

Figure 11:
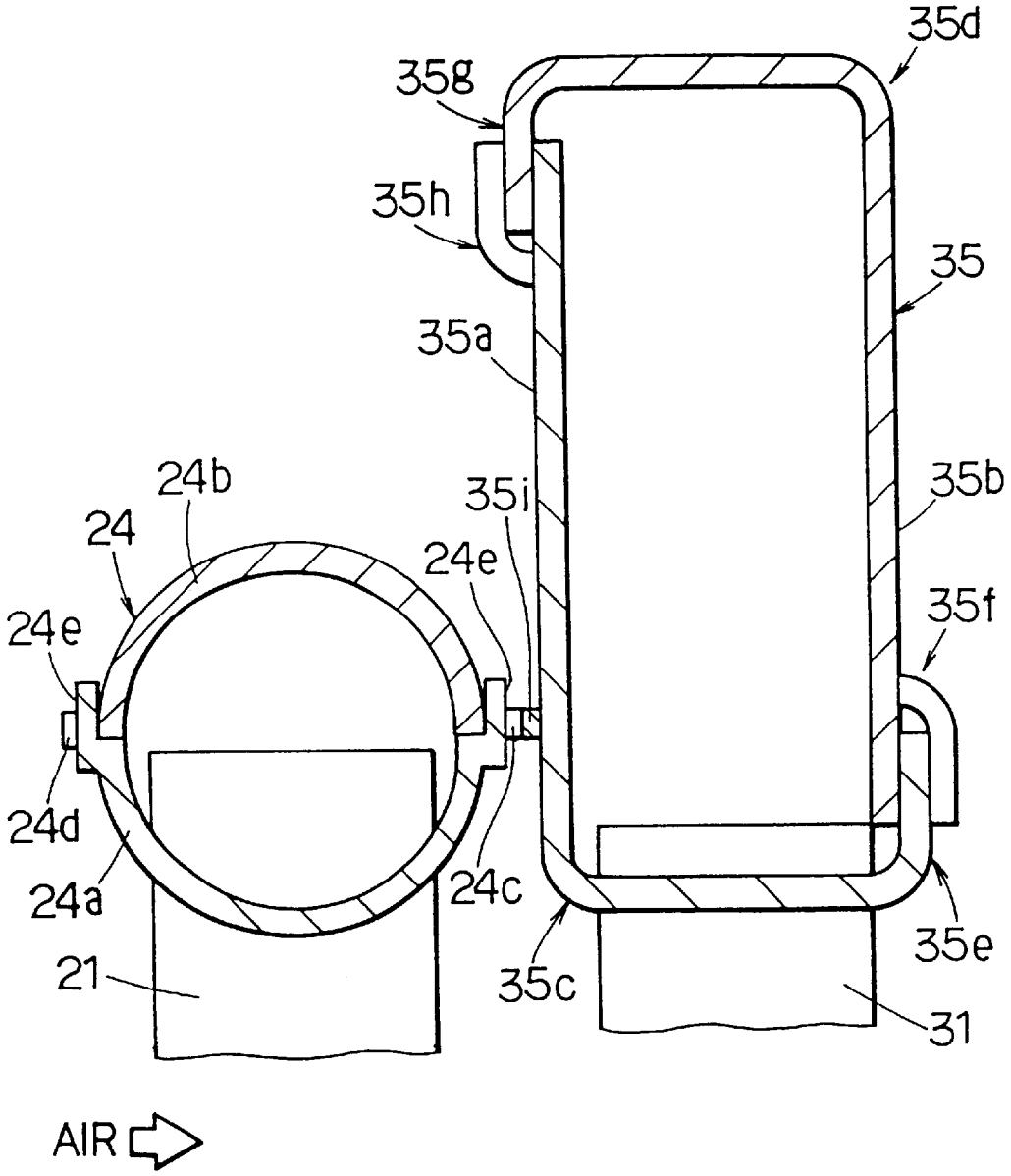
FIG. 11 is a cross-sectional view similar to FIG. 3 but showing a condenser header tank and a radiator header tank in accordance with another embodiment of the present invention.

For example, in the above-described first to third embodiments, the first protruding portion 24*c* protruding toward the radiator header tank 35 is provided in the condenser header tank 24 to contact the radiator header tank 35. However, the radiator header tank 35 may have several protruding portions 35; (FIG. 11) protruding toward the condenser header tank 24 and may contact the condenser header tank 24.

Such changes and modifications are to be understood as being within the scope of the present invention as defined by the appended claims.

What is claimed is:

1. A double heat exchanger comprising:

a first core for performing heat exchange between a first fluid and air, said first core having a plurality of first tubes through which said first fluid flows;

a first aluminum header tank extending in an extending direction perpendicular to a longitudinal direction of said first tubes and being connected to one end of each first tube in the longitudinal direction;

a second core for performing heat exchange between a second fluid and air, said second core having a plurality of second tubes through which said second fluid flows, the second fluid flowing through the second tubes being different from the first fluid flowing through the first tubes, a temperature difference between said second fluid and said first fluid being greater than a predetermined value; and a second aluminum header tank extending in a direction parallel to said extending direction of said first header tank and being connected to one end of each second tube in a longitudinal direction of said second tubes, wherein:

said first core and said second core are arranged in a straight line in an air flowing direction;

said first header tank has a first protruding portion separate from said second header tank which protrudes toward said second header tank to contact said second header tank;

said first protruding portion being brazed to said second header tank to form a clearance between an outer surface of the first header tank and an outer surface of the second header tank;

said first header tank includes a first plate connected to said first tubes, and a first tank portion connected to said first plate;

said first plate has a clamping portion protruding toward said first tank portion; and said clamping portion is bent in the extending direction of said first header tank when the first plate is connected to said first tank portion.

2. The double heat exchanger according to claim 1, wherein:

said first protruding portion protrudes from said first tank portion of said first header tank; and said clamping portion of said first plate of said first header tank is provided at a predetermined position to be engaged with said first protruding portion when the first plate is connected to said first tank portion.

* * * * *